United States Patent [19]

Treer

[11] Patent Number: 4,822,047

[45] Date of Patent: Apr. 18, 1989

[54] COMBINATION OF A GAME APPARATUS AND EDUCATIONAL DEVICE

[76] Inventor: Yuri P. Treer, 1320 S. 27 Pl., Birmingham, Ala. 35205

[21] Appl. No.: 93,176

[22] Filed: Sep. 3, 1987

Related U.S. Application Data

[63] Continuation-in-part of Ser. No. 848,810, Jul. 21, 1986, abandoned.

[51] Int. Cl.[4] ..... A63B 67/14; A63F 9/06

[52] U.S. Cl. ..... 273/113; 273/110; 273/153 R

[58] Field of Search ..... 273/113, 109, 110, 153 R

[56] References Cited

U.S. PATENT DOCUMENTS

| | | | |
|---|---|---|---|
| 2,644,890 | 7/1953 | Hollihan | 273/109 |
| 2,752,725 | 7/1956 | Unsworth | 273/109 |
| 3,901,510 | 8/1975 | Demaio | 273/113 |
| 4,451,038 | 5/1984 | Nagy | 273/113 |

*Primary Examiner*—Richard C. Pinkham
*Assistant Examiner*—Gary Jackson
*Attorney, Agent, or Firm*—Thad G. Long

[57] ABSTRACT

An apparatus in a combination of a game apparatus and educational device, comprising three major components, central housing, and left and right housings attached to it, and containing movable elements inside of the device, such as balls and dice, for which one attempts to get certain of the movable elements into positions within the left and right housings via various channels and apertures.

7 Claims, 3 Drawing Sheets

COMBINATION OF A GAME APPARATUS AND EDUCATIONAL DEVICE

FIELD OF THE INVENTION

This is a continuation-in-part of application Ser. No. 06/848,810 filed July 21, 1986 abandoned Oct. 30, 1987. The invention relates to a game apparatus and educational device.

Devices which engage the spatial perceptions and manipulative abilities of those who use them are valuable for enhancing those abilities, illustrating educational ideas, and entertaining. The subject invention can be utilized purely as an abstract device for challenging one's spatial perceptions and manipulative abilities, or it can go beyond that function to demonstrate certain left-right differences found in nature, such as the difference between the right and left sides of the human brain; it also can be used to amuse and entertain. The movable elements or game pieces which will be referred to below can be considered, in the context of the human brain analogy, to represent different attributes of the left side of the brain versus the right side, and the movable elements can even be placed in different locations with each right or left housing or hemisphere of the apparatus to represent schematically the supposed location within the human brain of particular attributes.

It is an object of this invention to provide a device, useful as a toy or game apparatus, amusement device and educational device, which can be used to represent and symbolize the human brain.

It is another object of this invention to provide a toy or game apparatus which appeals to the child and adult and which can serve as a conversation piece.

It is another object of this invention to place and maintain equal numbers of movable elements or game pieces on the respective sides of the invention and to move these elements to given levels in such respective sides.

It is still another object to exchange the movable elements which can symbolize exchange of brain functions.

It is another object of this invention to provide a device for manipulating from a cross-handed position.

It is another object of this invention to add complexity and challenge through the use of a central section, having one or more divisions, between the left and right housings or hemispheres.

It is still another object of this invention to add complexity and challenge through possible variations in directions or types of mazes, as between the right and left sides.

It is still another object of the invention to provide movable elements inside the apparatus and device, with shapes, colors, or markings which represent various brain attributes and to place said pieces in various locations in the left or right housing or hemisphere according to generally accepted scientific information as to the "seat" of said attributes within the brain.

DETAILED DESCRIPTION OF THE DRAWINGS

Figure 1:
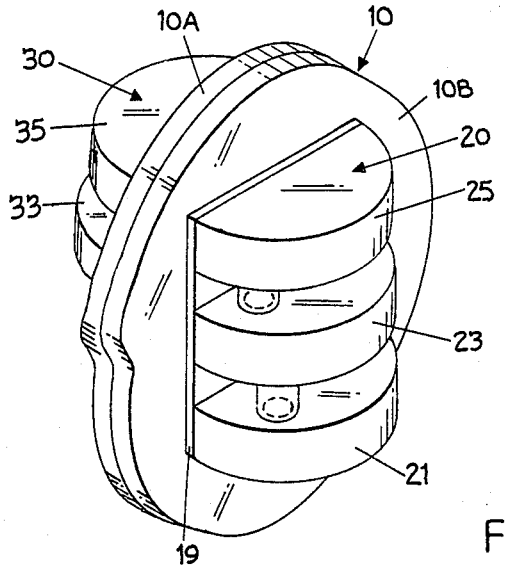
FIG. 1 is a perspective view of a preferred embodiment of the invention.

In FIG. 1 there is depicted an apparatus comprising three major components in which a central component is a housing 10 which is subdivided 10A and 10B to which is attached the second component, right housing 30, which consists of the three levels on the common sheet of plastic 19 and the third major component left housing 20. Levels 21, 23 and 25 are visible in left housing 20 and levels 33 and 35 are visible in right housing 30, level 31 being obscured by the central housing component 10.

Figure 2:
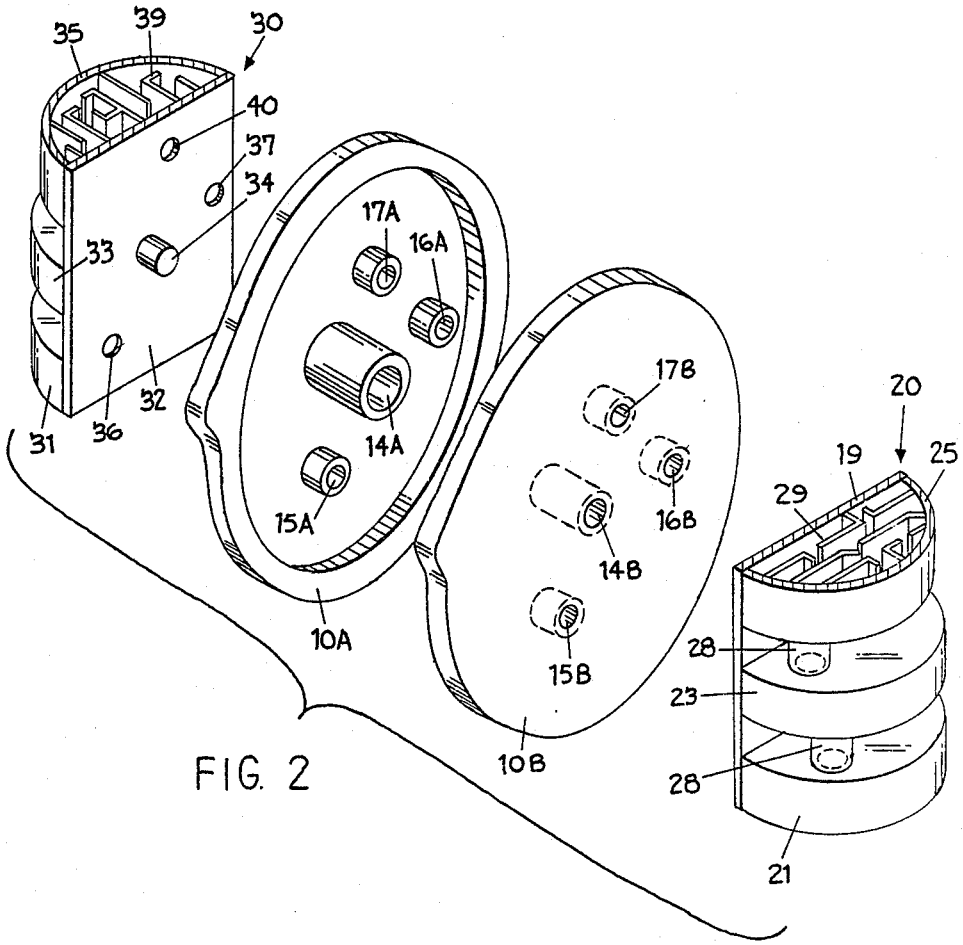
FIG. 2 is an exploded view of apparatus shown in FIG. 1.

FIG. 2 shows a central housing 10 and separate view of each part thereof showing a central cylindrical tube 14 which is a central rotational pivot 14A and 14B tube channels 15A and B, 16A and B and 17A and B. On the left side of FIG. 2 is right housing 30, with levels 31, 33, 35 on the common sheet of plastic 32 and three round openings, one on each level 36, 37, 40, and cylindrical tube on the second level on the other side 34, which goes inside of tube 14, of the central housing. On the right side of FIG. 2 there is a left housing 20 with three levels 21, 23, 25, on a common sheet of plastic 19, and interconnected channels 28. FIG. 2 also shows mazes 29 and 39 typical of the mazes at each level.

Figure 3:
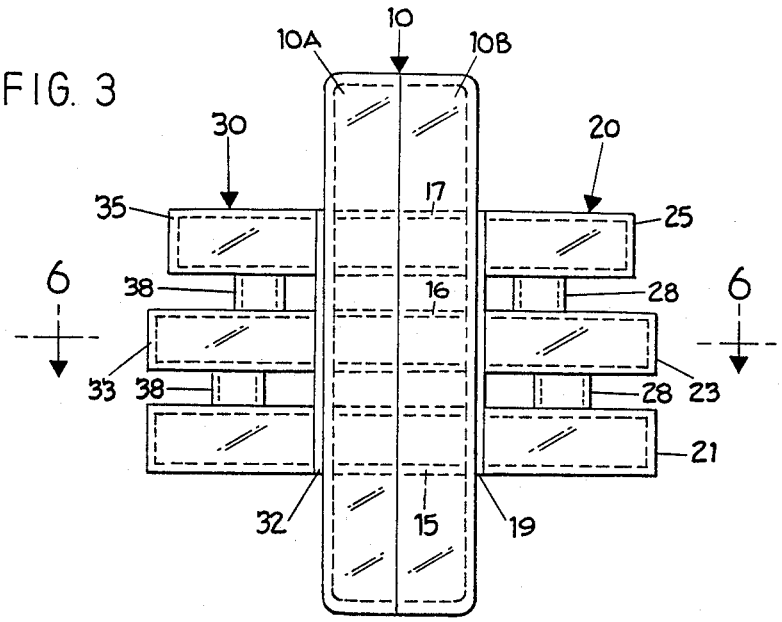
FIG. 3 is a front elevational view of the apparatus.

FIG. 3 is a front elevational view with a central housing 10, right housing 30, left housing 20, horizontal tube channels in attached positions 15,16,17 and vertical tube channels 28 and 38.

Figure 4:
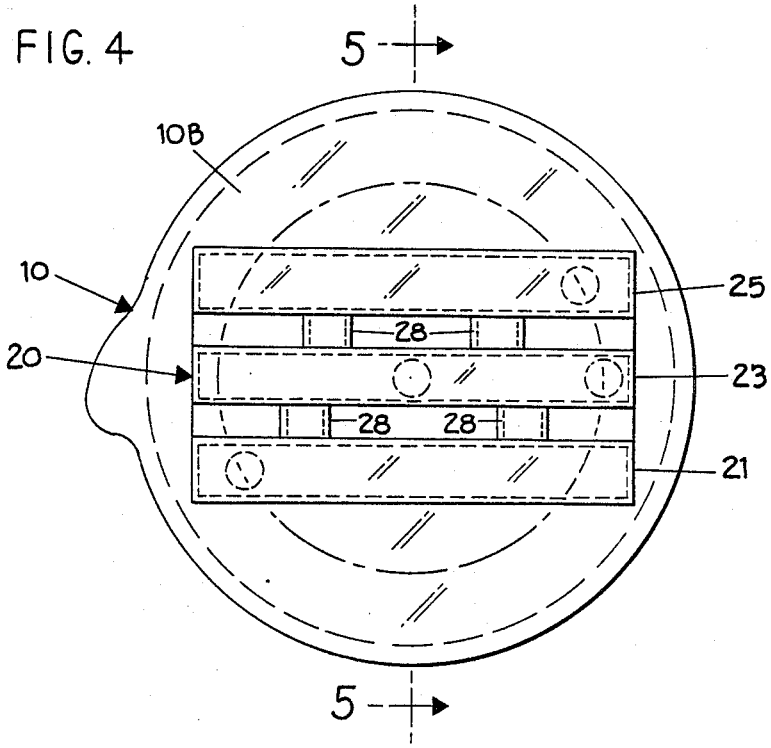
FIG. 4 is a side elevational view of the apparatus.

FIG. 4 is a side elevational view with a central housing 10, and three levels of the left housing 21, 23 and 25.

Figure 5:
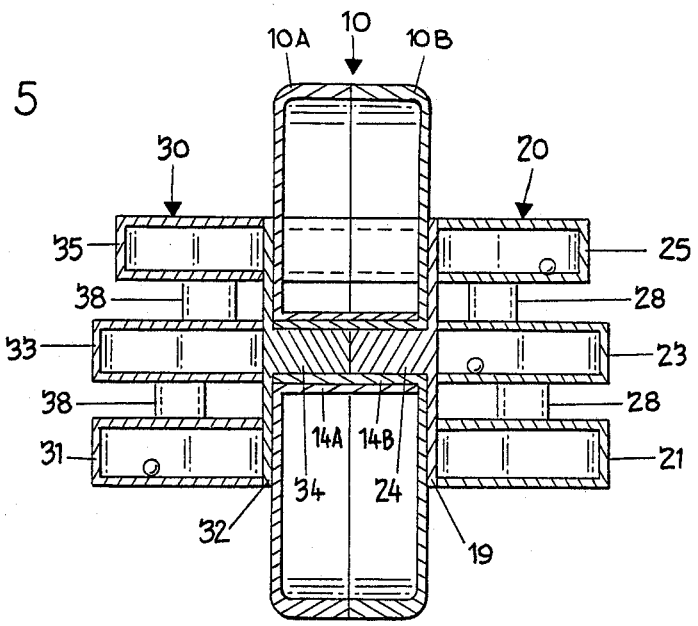
FIG. 5 is a cross sectional view taken on the line 5—5 of FIG. 4.

FIG. 5 is a detailed cross sectional view taken on the line 5—5 of FIG. 4 showing central housing 10, and pivot or axis tube 14.

Figure 6:
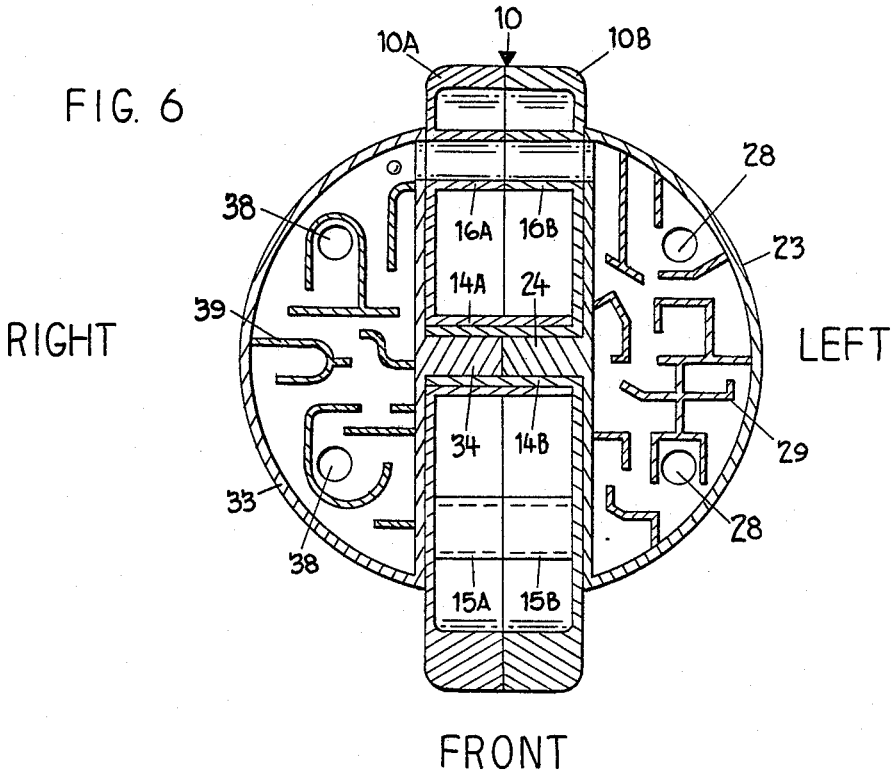
FIG. 6 is a cross sectional view taken on the line 6—6 of FIG. 3.

FIG. 6 is a detailed cross sectional view taken on the line 6—6 of FIG. 3 with one type of maze on the left housing 20, and another of mazes of right housing 30.

The invention is not intended to be restricted to any particular configuration. Other modifications or other embodiments, which will not depart from the concept of the invention may be devised.

The invention comprises any configuration with a right and left housing having a central disk-like housing, all of which pivot independently of each other about a given axis, having communicating channels among the right, left and central housings and apertures or channels connecting different levels (with mazes at each level) of the right and left housings, and movable elements or game pieces which can move through the various channels and apertures.

Although the invention may be made of any reasonably rigid material or materials, plastic will often be a preferred material because of the ease of molding component parts, durability, rigidity, minimal friction, transparency, and cost. Although not an essential part of the invention, it will often be desirable that at least part of the invention be transparent so that the movable elements or game pieces can be seen and so that channels and apertures can be seen, while the invention is being manipulated. If desired, the invention can be decorated with colors and designs, perhaps in a way that clearly differentiates the left and right housings.

The movable elements or game pieces can be any color and can have any markings, as long as they are not too large to traverse the channels and apertures. It will often be desirable, but is not essential to the invention, to have two distinctive and easily distinguishable sets of such movable elements or game pieces, one set designed to be brought into various positions in the right housing and the other set designed to be brought into various positions in the left housing. Such distinctiveness can be achieved by using different shapes, colors, configurations, or markings, or a combination thereof, between the two sets of movable elements or game pieces. Within each of the two distinctive sets of movable elements or game pieces, it may be desirable further to distinguish the individual articles or pieces, especially if the invention is being used to test one's ability to manipulate certain particular elements or pieces into certain specific individual positions. This further distinctiveness can be achieved in a variety of ways, such as numbering, lettering or marking the individual pieces with different numbers, letters, or any other marking, or by shades of colors or by variations of shapes or in other similar ways.

The right and left housings will often be generally hemispherical in shape but may be or an irregular hemisphere (e.g., a generally circular circumference adjacent to the central housing but having non-uniform distances from the cnter of such circular circumference to various points on the surface of such hemisphere.

I claim:

1. A game apparatus comprising a central housing, a left housing and a right housing; said central housing comprising one or more substantially identical generally disk shaped members with one or more tubular members attached perpendicularly to said central housing, each said disk shaped member having a plurality of channels spaced about an axis, and, in the case of multiple said disk shaped members, said channels on all said disk shaped members being alignable with the channels of all other said disk shaped members; each of said right and left housings having movable elements therein and comprising two or more vertically separated levels of enclosed communicating maze members and a means for communicating between each level, said maze members being attached to a planar sheet member, said sheet members having at least one aperture in communication with each of said levels, said sheet members further having means for pivotally engaging said tubular members of said central housing; said at least one apeture being alignable with at least one of said channels in said central housing such that said movable elememts can move between said right and left housings through said central housing channels.

2. A game apparatus as in claim 1 wherein said right and left housings are at least partially of transparent plastic.

3. A game apparatus as in claim 1 wherein said means for communicating between each level includes at least one hollow cylindrical element between each of said levels.

4. A game apparatus as in claim 1 wherein one or more of said movable elements are spherical members and certain others of said movable elements are dice shaped members, each of which movable elements can be shifted from the right to left housing through said apertures and channels.

5. A game apparatus as in claim 1 wherein one or more of said movable elements are of one color and certain others of said movable elements are of one or more different colors.

6. A game apparatus as in claim 1 wherein certain of said movable elements have distinctive markings and certain others of said movable elements have different distinctive markings.

7. A game apparatus as in claim 1 wherein certain of said movable elements can be distinguished from others of said movable elements by shape.

* * * * *